US009709924B2

(12) United States Patent
Kawata

(10) Patent No.: US 9,709,924 B2
(45) Date of Patent: Jul. 18, 2017

(54) DEVELOPER CONTAINER, DEVELOPING DEVICE, PROCESS CARTRIDGE, AND IMAGE FORMING APPARATUS

(71) Applicant: CANON KABUSHIKI KAISHA, Tokyo (JP)

(72) Inventor: Kentaro Kawata, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/077,522

(22) Filed: Mar. 22, 2016

(65) Prior Publication Data

US 2016/0282758 A1 Sep. 29, 2016

(30) Foreign Application Priority Data

Mar. 27, 2015 (JP) ..... 2015-065553

(51) Int. Cl.
*G03G 15/08* (2006.01)
*G03G 21/16* (2006.01)

(52) U.S. Cl.
CPC ..... *G03G 15/0865* (2013.01); *G03G 15/0831* (2013.01); *G03G 15/0839* (2013.01); *G03G 15/0856* (2013.01); *G03G 15/0877* (2013.01); *G03G 21/1676* (2013.01); *G03G 2215/00569* (2013.01)

(58) Field of Classification Search
CPC ..... G03G 15/0831; G03G 15/0839; G03G 15/0865; G03G 15/0856; G03G 15/0877; G03G 21/1676; G03G 2215/00569
USPC ..... 399/258, 261
See application file for complete search history.

(56) References Cited

U.S. PATENT DOCUMENTS

| | | | | |
|---|---|---|---|---|
| 7,881,623 | B2 * | 2/2011 | Yamaguchi | G03G 15/553 399/258 |
| 7,899,369 | B2 | 3/2011 | Kurogawa | |
| 8,064,806 | B2 | 11/2011 | Nishiwaki et al. | |
| 8,081,909 | B2 | 12/2011 | Nishiwaki et al. | |
| 8,874,010 | B2 * | 10/2014 | Wada | G03G 15/0822 399/258 |
| 2007/0286645 | A1 | 12/2007 | Hayashi | |
| 2009/0060590 | A1 * | 3/2009 | Kurogawa | G03G 15/0877 399/265 |
| 2009/0129822 | A1 | 5/2009 | Toh et al. | |
| 2012/0163876 | A1 | 6/2012 | Wada | |
| 2014/0219688 | A1 | 8/2014 | Murata et al. | |
| 2016/0097993 | A1 | 4/2016 | Shinohara et al. | |

FOREIGN PATENT DOCUMENTS

| | | | |
|---|---|---|---|
| JP | 59-227618 | A | 12/1984 |
| JP | 04178671 | A | 6/1992 |
| JP | 2002-196585 | A | 7/2002 |

* cited by examiner

*Primary Examiner* — Hoang Ngo
(74) *Attorney, Agent, or Firm* — Canon USA, Inc. I.P. Division

(57) ABSTRACT

An image forming apparatus includes a frame configured to contain a developer, a conveyance member configured to convey the developer, a detection unit configured to detect a developer amount of the developer inside the frame, and an adjustment unit configured to adjust a vibration condition of the conveyance member, wherein the adjustment unit adjusts the vibration condition of the conveyance member according to a result of detection by the detection unit.

17 Claims, 14 Drawing Sheets

FIG.8

| CYCLE | NUMBER OF SHEETS | IMAGE | COVERAGE RATE | NUMBER OF SHEETS | FREQUENCY |
|---|---|---|---|---|---|
| 1 | 1 - 50 | (1) | 30% | 2 - 51 | 40 Hz |
| | 51 - 100 | (2) | 5% | 52 - 101 | 10 Hz |
| | 101 - 150 | (3) | 1% | 102 - 151 | 2 Hz |
| 2 | 151 - 200 | (1) | 30% | 152 - 201 | 40 Hz |
| | 201 - 250 | (2) | 5% | 202 - 251 | 10 Hz |
| | 251 - 300 | (3) | 1% | 252 - 301 | 2 Hz |
| . . . | . . . | . . . | . . . | . . . | . . . |
| 8 | 1051 - 1100 | (1) | 30% | 1052 - 1101 | 40 Hz |
| | 1101 - 1150 | (2) | 5% | 1102 - 1151 | 10 Hz |
| | 1151 - 1200 | (3) | 1% | 1152 - 1200 | 2 Hz |

FIG.9

| CYCLE | NUMBER OF SHEETS | IMAGE | COVERAGE RATE | TONER AMOUNT | NUMBER OF SHEETS | FREQUENCY |
|---|---|---|---|---|---|---|
| 1 | 1 - 50 | (1) | 30% | 94 g | 2 - 51 | 40 Hz |
| | 51 - 100 | (2) | 5% | 93 g | 52 - 101 | 10 Hz |
| | 101 - 150 | (3) | 1% | 92 g | 102 - 151 | 2 Hz |
| 2 | 151 - 200 | (1) | 30% | 86 g | 152 - 201 | 40 Hz |
| | 201 - 250 | (2) | 5% | 85 g | 202 - 251 | 10 Hz |
| | 251 - 300 | (3) | 1% | 84 g | 252 - 301 | 2 Hz |
| ... | ... | ... | ... | ... | ... | ... |
| 7 | 1001 - 1050 | (3) | 1% | 44 g | 1002 - 1051 | 4 Hz |
| 8 | 1051 - 1100 | (1) | 30% | 38 g | 1052 - 1101 | 45 Hz |
| | 1101 - 1150 | (2) | 5% | 37 g | 1102 - 1151 | 15 Hz |
| | 1151 - 1200 | (3) | 1% | 36 g | 1152 - 1200 | 4 Hz |

FIG.11

| CYCLE | NUMBER OF SHEETS | IMAGE | COVERAGE RATE | ROTATION TIME OF DEVELOPING ROLLER | NUMBER OF SHEETS | FREQUENCY |
|---|---|---|---|---|---|---|
| 1 | 1 - 50 | (1) | 30% | 200 SECONDS | 2 - 51 | 40 Hz |
| | 51 - 100 | (2) | 5% | 400 SECONDS | 52 - 101 | 10 Hz |
| | 101 - 150 | (3) | 1% | 600 SECONDS | 102 - 151 | 2 Hz |
| 2 | 151 - 200 | (1) | 30% | 800 SECONDS | 152 - 201 | 40 Hz |
| | 201 - 250 | (2) | 5% | 1000 SECONDS | 202 - 251 | 10 Hz |
| | 251 - 300 | (3) | 1% | 1200 SECONDS | 252 - 301 | 2 Hz |
| . . . | . . . | . . . | . . . | . . . | . . . | . . . |
| 7 | 1001 - 1050 | (3) | 1% | 4200 SECONDS | 1002 - 1051 | 2 Hz |
| 8 | 1051 - 1100 | (1) | 30% | 4400 SECONDS | 1052 - 1101 | 38 Hz |
| | 1101 - 1150 | (2) | 5% | 4600 SECONDS | 1102 - 1151 | 9 Hz |
| | 1151 - 1200 | (3) | 1% | 4800 SECONDS | 1152 - 1200 | 1.5 Hz |

DEVELOPER CONTAINER, DEVELOPING DEVICE, PROCESS CARTRIDGE, AND IMAGE FORMING APPARATUS

BACKGROUND OF THE INVENTION

Field of the Invention

Aspects of the present invention generally relate to a developer container, a developing device, a process cartridge, and an image forming apparatus. In the present specification, the image forming apparatus includes, for example, an electrophotographic copying machine that forms an image on a recording material using an electrophotographic image forming process. Moreover, the image forming apparatus includes, for example, an electrophotographic printer, such as a laser beam printer and a light-emitting diode (LED) printer, and a facsimile apparatus.

Description of the Related Art

Japanese Patent Application Laid-Open No. 2002-196585 discusses an image forming apparatus in which an agitation conveyance member that conveys a developer contained in a developer container, which is detachably attached to the inside of the image forming apparatus, toward a developing roller while agitating the developer is mounted inside the developer container. In the image forming apparatus discussed in Japanese Patent Application Laid-Open No. 2002-196585, a plurality of agitation conveyance members is used.

Furthermore, Japanese Patent Application Laid-Open No. 59-227618 discusses a conveyance apparatus for particulates that includes a bearing member for particulates, which is swingably supported, and a vibration generation device, which applies vibration to the bearing member, and that conveys particulates borne by the bearing member by vibrating the bearing member.

However, in the image forming apparatus discussed in Japanese Patent Application Laid-Open No. 2002-196585, the agitation conveyance member conveys only a developer situated within the radius of rotation of the agitation conveyance member. Therefore, the bottom surface of the developer container needs to be formed in a circular arc shape in cross section. For example, a protrusion is formed on a floor surface of the developer container that the agitation conveyance member is unable to reach, in such a manner that any developer does not stay on the area of the protrusion. Since the protrusion becomes a dead space, the volume to contain a developer may decrease.

Furthermore, in the conveyance apparatus discussed in Japanese Patent Application Laid-Open No. 59-227618, a space within which the entire bearing member swings needs to be secured. The space also becomes a dead space.

In order to reduce a dead space on the conveyance route for a developer, it is conceivable that a plate-like conveyance member can be swung along the developer conveyance direction at reciprocating accelerations to convey a developer situated on the plate-like conveyance member.

In the case of vibrating the plate-like conveyance member to convey a developer situated on the plate-like conveyance member, the developer may be oversupplied or undersupplied to a developer bearing member depending on the condition of vibration. As a result, a reduced density or a blank area may occur on a toner image formed on the recording material.

The reason for this is described with the use of a comparative example illustrated in FIG. 14 as follows. FIG. 14 is a sectional view illustrating the configuration of a process cartridge B serving as a comparative example, in which a developer conveyance plate 14*b*, which constitutes the bottom surface of a developer container 14, is vibrated alternately in a developer conveyance direction J1 and in a developer counter-conveyance direction J2, so that a developer situated on the developer conveyance plate 14*b* is conveyed.

Referring to FIG. 14, a developer in the developer container 14 is conveyed by the vibration of the developer conveyance plate 14*b* toward a developing roller 10*d*, which serves as a developer bearing member, in the developer conveyance direction J1, and is then supplied to the developing roller 10*d* in a developing chamber 10*i*.

At this time, the amount of a developer (a developer amount) in the developing chamber 10*i* and a powder pressure of the developer, which is powder, greatly influence the performance of supply of a developer that is supplied to the developing roller 10*d*. If the powder pressure of the developer continues being high with the developer amount in the developing chamber 10*i* becoming excessive, particles of the developer may be aggregated so that the developer cannot exert the fluidity for particulates.

As a result, although a developer present near the surface of the developing roller 10*d* is supplied to the developing roller 10*d*, a subsequent developer is hard to be moved and supplied to the developing roller 10*d* due to the insufficient fluidity, so that it becomes difficult to keep a good state of supply of a developer to the developing roller 10*d*. If the supply of a developer to the developing roller 10*d* stagnates, the amount of a developer borne on the surface of the developing roller 10*d* may become insufficient, so that a reduced density or a blank area, in which an image is left white, may occur on a toner image formed on the recording material 2.

Furthermore, even in a case where the developer amount in the developing chamber 10*i* is too small, the amount of supply of the developer to the developing roller 10*d* may also become insufficient.

In this way, the developer amount in the developing chamber 10*i* and the powder pressure of the developer greatly influence the performance of supply of the developer to the developing roller 10*d*. Then, the developer amount in the developing chamber 10*i* and the powder pressure of the developer are determined by the inflow velocity Vi of a developer that flows into the developing chamber 10*i* and the outflow velocity Vo of a developer that flows out from the developing chamber 10*i*. If the inflow velocity Vi and the outflow velocity Vo meet the relationship indicated by the following mathematical expression (1), the developing chamber 10*i* is in an excessive inflow state in which the amount of a developer that flows into the developing chamber 10*i* is larger than the amount of a developer that flows out from the developing chamber 10*i*. At this time, the developer amount in the developing chamber 10*i* increases and the powder pressure of the developer rises.

$$Vi > Vo \quad (1)$$

On the other hand, if the inflow velocity Vi and the outflow velocity Vo meet the relationship indicated by the following mathematical expression (2), the developing chamber 10*i* is in an excessive outflow state in which the amount of a developer that flows out from the developing chamber 10*i* is larger than the amount of a developer that flows into the developing chamber 10*i*. At this time, the developer amount in the developing chamber 10*i* decreases and the powder pressure of the developer lowers.

$$Vi < Vo \quad (2)$$

Ideally, if the inflow velocity Vi and the outflow velocity Vo meet the relationship indicated by the following mathematical expression (3), both the developer amount in the developing chamber 10*i* and the powder pressure of the developer can be kept into an appropriate state, so that the supply state of the developer to the developing roller 10*d* can also be kept always appropriate.

$$Vi=Vo \quad (3)$$

As illustrated in FIG. 14, the developer in the developer container 14 is conveyed in the developer conveyance direction J1 by the vibration of the developer conveyance plate 14*b* and is then supplied to the developing roller 10*d* in the developing chamber 10*i*. The developer borne on the surface of the developing roller 10*d* is consumed by image formation. Thus, the developer in the developing chamber 10*i* sequentially decreases for each image formation.

The factor affecting the inflow velocity Vi of a developer that flows into the developing chamber 10*i* includes, for example, a vibration condition of the developer conveyance plate 14*b* and a conveyance performance of the developer itself. On the other hand, the factor affecting the outflow velocity Vo of a developer that flows out from the developing chamber 10*i* includes, for example, a coverage rate (printing ratio) of a toner image to be formed on the recording material 2.

In a case where the developer conveyance plate 14*b* is set to a predetermined vibration condition, if the outflow velocity Vo of a developer that flows out from the developing chamber 10*i* and the conveyance performance of the developer itself do not vary, there is no problem. However, actually, the coverage rate of a toner image to be formed on the recording material 2 varies for each print job, and the conveyance performance of the developer itself also varies with repetition of use. Therefore, in a case where the vibration condition of the developer conveyance plate 14*b* is fixed, it is difficult to keep always optimum the balance between the inflow velocity Vi of a developer that flows into the developing chamber 10*i* and the outflow velocity Vo of a developer that flows out from the developing chamber 10*i*.

SUMMARY OF THE INVENTION

Aspects of the present invention are generally directed to an image forming apparatus capable of maintaining the inflow and outflow balance of a developer during the vibratory conveyance of the developer.

According to an aspect of the present invention, an image forming apparatus includes a frame configured to contain a developer, a conveyance member configured to convey the developer, a detection unit configured to detect a developer amount of the developer inside the frame, and an adjustment unit configured to adjust a vibration condition of the conveyance member, wherein the adjustment unit adjusts the vibration condition of the conveyance member according to a result of detection by the detection unit.

Further features of the present invention will become apparent from the following description of exemplary embodiments with reference to the attached drawings.

BRIEF DESCRIPTION OF THE DRAWINGS

FIG. 8 illustrates an outline of Experiment 1 using the first exemplary embodiment.

FIG. 9 illustrates an outline of Experiment 2 using the first exemplary embodiment.

FIG. 11 illustrates an outline of Experiment 3 using the second exemplary embodiment.

DESCRIPTION OF THE EMBODIMENTS

Various exemplary embodiments of an image forming apparatus to which a process cartridge equipped with a developing device including a developer container is detachably attached according to the present invention will be described in detail below with reference to the drawings. However, the dimension, material, shape, relative position, and other factors of each constituent component described in each of the following exemplary embodiments are not limiting. Furthermore, in the following description, the longitudinal direction of a process cartridge refers to the axial direction of an image bearing member.

First, a configuration of an image forming apparatus to which a process cartridge equipped with a developing device including a developer container is detachably attached according to a first exemplary embodiment of the present invention is described with reference to FIGS. 1 to 9.

<Image Forming Apparatus>

Figure 1:
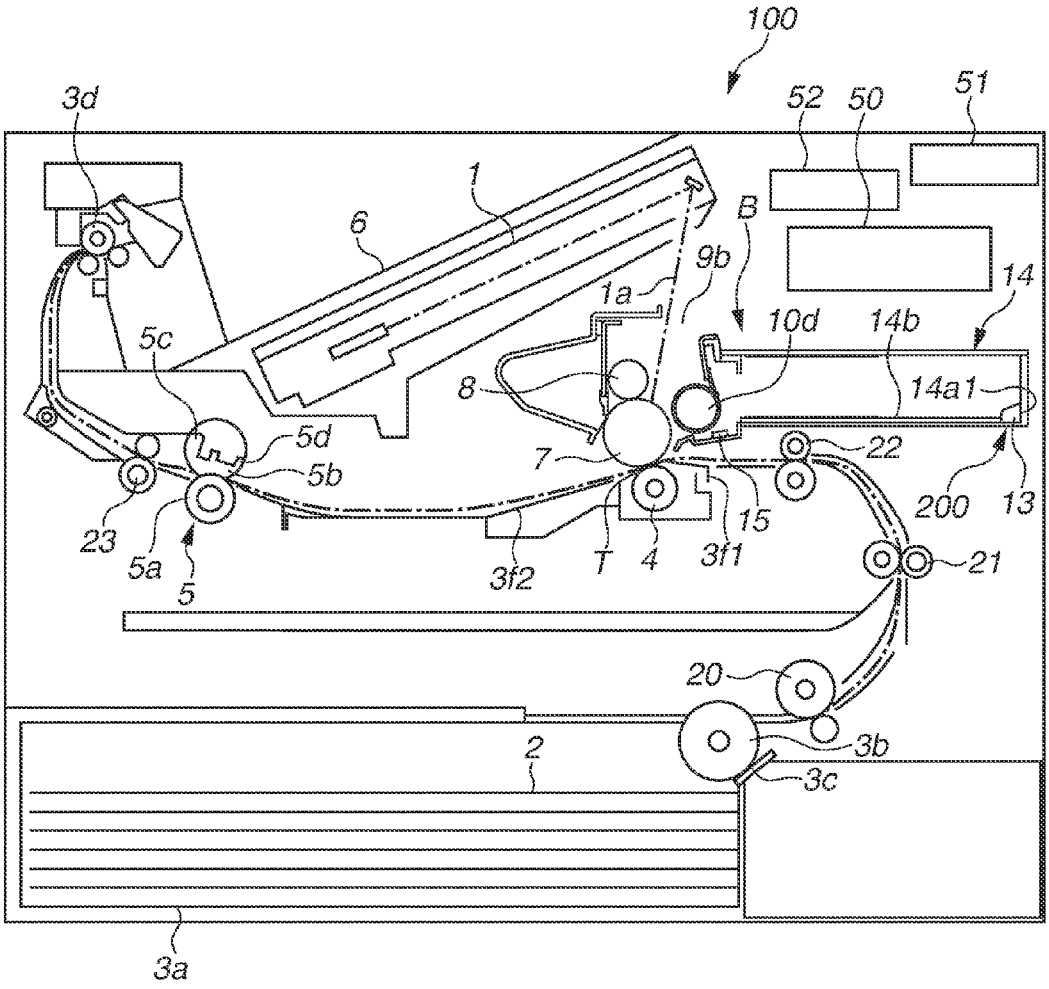
FIG. 1 is a sectional view illustrating a configuration of an image forming apparatus to which a process cartridge equipped with a developing device including a developer container is detachably attached according to a first exemplary embodiment of the present invention.

The overall configuration of an image forming apparatus 100 of the electrophotographic type is described with reference to FIG. 1. FIG. 1 is a sectional view illustrating the configuration of the image forming apparatus 100 to which a process cartridge B is attached according to the first exemplary embodiment. The image forming apparatus 100 according to the present exemplary embodiment is, for example, a laser beam printer.

As illustrated in FIG. 1, the image forming apparatus 100 is provided with a process cartridge B, which is detachably attached to the body of the image forming apparatus 100. The process cartridge B includes a photosensitive drum 7, which serves as an image bearing member.

Furthermore, the image forming apparatus 100 includes a laser scanner 1, which serves as an image exposure unit. The laser scanner 1 throws laser light 1*a* corresponding to image information for scanning and exposure on the surface of the photosensitive drum 7 uniformly charged by a charging roller 8, which serves as a charging unit, illustrated also in FIG. 2. This causes an electrostatic latent image to be formed on the surface of the photosensitive drum 7.

Figure 5:
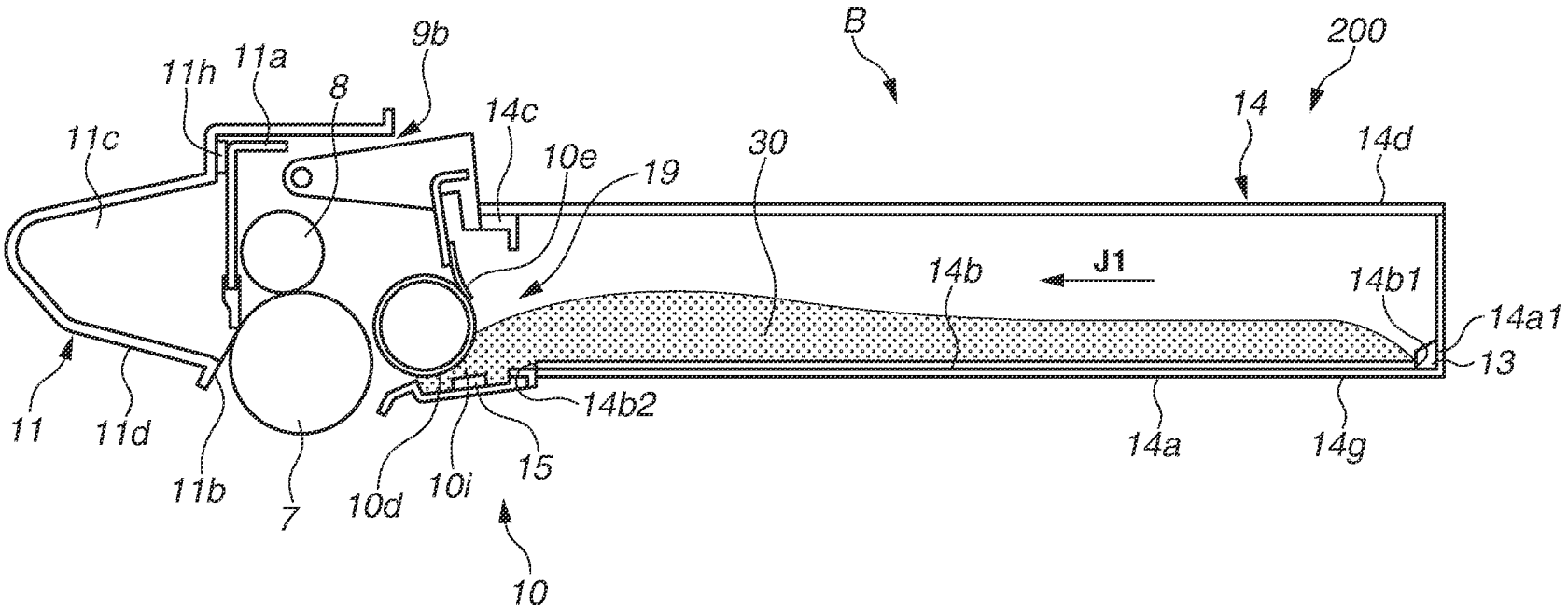
FIG. 5 is a sectional view illustrating a state in which the amount of a toner (a toner amount) in a developing chamber of the developing device and a powder pressure of the developer are appropriate in the first exemplary embodiment.

Then, a developing bias voltage is applied to a developing roller 10*d*, which serves as a developer bearing member that bears toner 30, serving as a developer, illustrated in FIG. 5. With this, the toner 30, serving as a developer, borne on the surface of the developing roller 10*d* is supplied to an electrostatic latent image formed on the surface of the photosensitive drum 7 to bring out the electrostatic latent image, so that a toner image is formed on the surface of the photosensitive drum 7.

On the other hand, a recording material 2 is picked up by a pickup roller 3*b* from a feed cassette 3*a*, illustrated in FIG. 1, in synchronization with the operation for forming a toner image on the surface of the photosensitive drum 7. Examples of the recording material 2 include paper, an over head transparency (OHT) sheet, which is a transparent sheet used for an over head projector (OHP), and a cloth. Then, the recording material 2 is separated and fed on a sheet-by-sheet basis by the cooperation of the pickup roller 3*b* and a separation member 3*c*, which is kept in press contact with the pickup roller 3*b*.

The recording material 2, which has been separated and fed on a sheet-by-sheet basis by the cooperation of the pickup roller 3*b* and the separation member 3*c*, is sequentially conveyed by conveyance rollers 20 and 21, and the fore end of the recording material 2 then collides with a registration roller pair 22, which is temporarily stopped at this time. Then, the fore end of the recording material 2 is struck along the nip portion of the registration roller pair 22 due to the strength of stiffness of the recording material 2, so that any skew of the recording material 2 is corrected.

Then, the recording material 2 is nipped and conveyed by the registration roller pair 22 while being adjusted to the position of a toner image formed on the surface of the photosensitive drum 7. Then, the recording material 2 is conveyed along a conveyance guide 3*f*1 to a transfer nip portion T, at which the photosensitive drum 7, which is mounted in the process cartridge B, faces and contacts a transfer roller 4, which serves as a transfer unit.

Then, a transfer bias voltage is applied to the transfer roller 4, so that the toner image formed on the surface of the photosensitive drum 7 is transferred onto the recording material 2 conveyed to the transfer nip portion T. The recording material 2, onto which the toner image has been transferred, is conveyed along a conveyance guide 3*f*2 to a fixing device 5, which serves as a fixing unit.

The fixing device 5 includes a driving roller 5*a* and a fixing rotary member 5*d*, which has a built-in heater 5*b* and which is configured with a tubular sheet rotatably supported by a supporting member 5*c*. Then, heat and pressure are applied to the recording material 2, which passes through a fixing nip portion between the fixing rotary member 5*d* and the driving roller 5*a*, so that the toner image is heated and fixed to the recording material 2.

The recording material 2, to which the toner image has been heated and fixed by the fixing device 5, is conveyed by a conveyance roller 23 to a discharge roller 3*d*. The discharge roller 3*d* discharges the recording material 2 having the toner image fixed thereto to a discharge portion 6. In this way, the image forming apparatus 100 forms an image on the recording material 2 using the toner 30.

Figure 4:
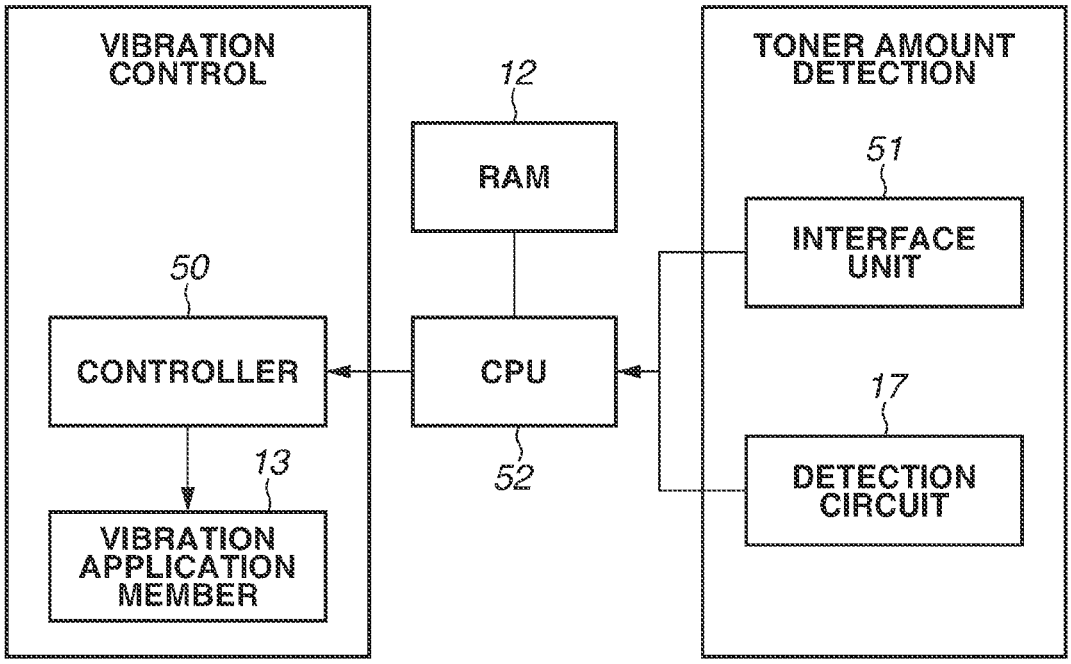
FIG. 4 is a block diagram illustrating a configuration of a control system in the image forming apparatus to which the process cartridge equipped with the developing device including the developer container is detachably attached according to the first exemplary embodiment.

An interface unit 51, which is illustrated in FIGS. 1 and 4, is an interface that connects an external device, such as a personal computer, with the image forming apparatus 100. The interface unit 51 is connected to a central processing unit (CPU) 52, which serves as a control unit.

The CPU 52 performs, via a controller 50, driving of the components mounted in the image forming apparatus 100, control of various operations of the image forming apparatus 100, such as application of voltages, and data processing. The controller 50 also serves as a control unit that controls the amount of conveyance of a developer that is conveyed by a developer conveyance plate 14*b*, which serves as a conveyance member that conveys the toner 30, serving as the developer, placed on the conveyance member.

Figure 2:
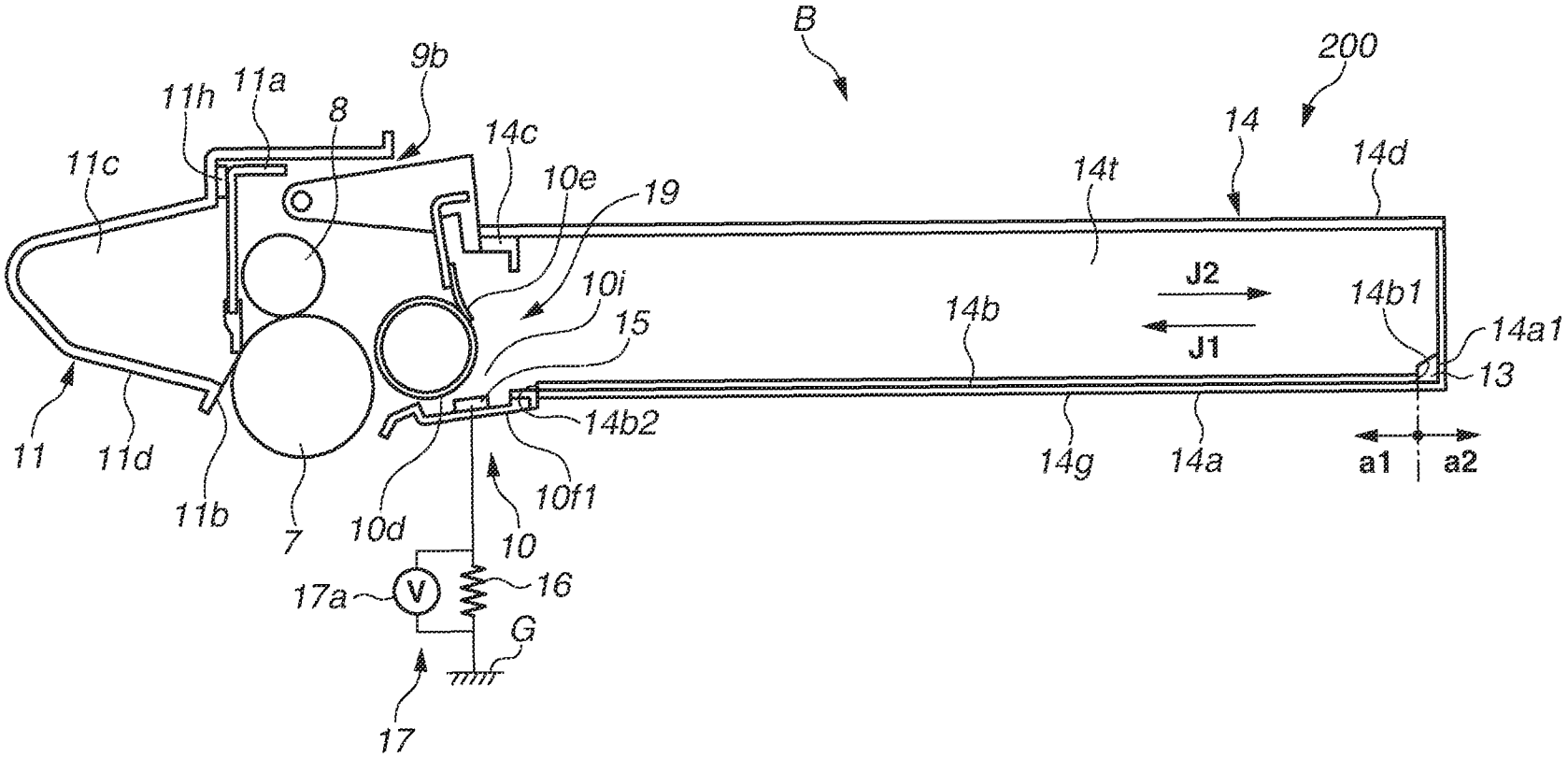
FIG. 2 is a sectional view illustrating a configuration of the process cartridge equipped with the developing device including the developer container according to the first exemplary embodiment.

The developer conveyance plate 14*b* conveys a developer placed on the developer conveyance plate 14*b* by moving while vibrating both in a developer conveyance direction J1 and a developer counter-conveyance direction J2, which is opposite the developer conveyance direction J1, illustrated in FIG. 2. The controller 50 controls a vibrating operation of a vibration application member 13 to control the amount of conveyance of a developer that is conveyed by the developer conveyance plate 14*b*, which serves as a conveyance member.

<Process Cartridge>

Next, a configuration of the process cartridge B is described with reference to FIG. 2. FIG. 2 is a sectional view illustrating the configuration of the process cartridge B. As illustrated in FIG. 2, the process cartridge B according to the present exemplary embodiment includes the photosensitive drum 7, which serves as an image bearing member that bears a toner image (developer image), and at least one image forming process unit.

The image forming process unit includes the charging roller 8, which serves as a charging unit that charges the surface of the photosensitive drum 7, and a developing device 10, which serves as a developing unit that develops an electrostatic latent image formed on the surface of the photosensitive drum 7. The image forming process unit further includes, among others, a cleaning blade 11*a*, which serves as a cleaning unit that removes toner 30 remaining on the surface of the photosensitive drum 7 after the toner image is transferred to the recording material 2.

A drum unit 11 illustrated in FIG. 2 includes a drum frame 11*d*, which supports the photosensitive drum 7 in such a way as to allow the photosensitive drum 7 to rotate. Furthermore, the cleaning blade 11*a* is mounted on the drum frame 11*d*. Moreover, the charging roller 8 is rotatably mounted on the drum frame 11*d*. Additionally, the drum frame 11*d* is provided with a removed toner storage portion 11*c* and a scooping sheet 11*b*.

The developing device 10 includes a developing frame 10*f*1, which supports the developing roller 10*d* in such a way as to allow the developing roller 10*d* to rotate. The developing frame 10*f*1 is provided with a developing chamber 10*i*.

In the process cartridge B, the photosensitive drum 7, which has a photosensitive layer, is rotated, and a charging bias voltage is applied to the charging roller 8, which serves as a charging unit, to uniformly charge the surface of the photosensitive drum 7. Then, laser light 1*a* (light image) generated based on image information is thrown from the laser scanner 1 illustrated in FIG. 1 via the exposure aperture 9*b* for scanning and exposure on the charged surface of the photosensitive drum 7, so that an electrostatic latent image is formed on the surface of the photosensitive drum 7. Then, the toner 30 is supplied by the developing device 10 to the electrostatic latent image formed on the surface of the photosensitive drum 7, so that the electrostatic latent image is developed as a toner image.

<Developer Container>

The developer container 14, which contains the toner 30, includes a frame member 14*a*, which serves as a frame that contains the toner 30 serving as a developer, and the developer conveyance plate 14*b*, which serves as a plate-like conveyance member that conveys the toner 30 placed thereon. The frame member 14*a* functions as the outer shell of the developer container 14. The developer conveyance plate 14*b* is configured as the bottom surface of the developer container 14 and is supported in such a way as to be movable both in the developer conveyance direction J1 and the developer counter-conveyance direction J2 relative to the frame member 14*a*.

The developer conveyance plate 14*b*, which serves as a conveyance member according to the present exemplary embodiment, is movably mounted inside the developer container 14 (inside a developer container). The vibration application member 13 is fixed between one end portion 14*a*1 of the frame member 14*a* of the developer container 14 and an end portion 14*b* (one end portion) of the developer conveyance plate 14*b*, which serves as a conveyance member. The vibration application member 13 is mounted at the side opposite an opening 19 in the developer conveyance direction J1 illustrated in FIG. 2. In the present exemplary embodiment, the vibration application member 13, which is composed of a piezoelectric element, is fixed to the end portion 14*b*1 of the developer conveyance plate 14*b* on the side to which the developer counter-conveyance direction J2 points.

The vibration application member 13 according to the present exemplary embodiment is composed of an elastic member (piezoelectric element) that expands when a voltage is applied thereto and shrinks to the original size when a voltage is stopped from being applied thereto. The waveform and frequency of the voltage to be applied to the vibration application member 13 are appropriately controlled. This enables the occurrence of an acceleration difference (a1<a2) between an acceleration a1 at which to move the developer conveyance plate 14*b* in the developer conveyance direction J1 (forward path) and an acceleration a2 at which to move the developer conveyance plate 14*b* in the developer counter-conveyance direction J2 (backward path).

For example, the voltage to be applied to the vibration application member 13, which is composed of a piezoelectric element, is set to 500 V, the voltage waveform is set to a rectangular wave, and the frequency of the applied voltage is set to 60 Hz. More specifically, for example, a direct-current voltage to be applied by a direct-current power supply (not illustrated) to electrodes provided at both end portions of the vibration application member 13 is slowly raised. This enables the acceleration a1, at which to move the developer conveyance plate 14*b* in the developer conveyance direction J1 (forward path), to act small.

Furthermore, a direct-current voltage to be applied to the electrodes provided at both end portions of the vibration application member 13 is rapidly lowered. This enables the acceleration a2, at which to move the developer conveyance plate 14*b* in the developer counter-conveyance direction J2 (backward path), to act greatly. Thus, this enables the occurrence of the acceleration difference (a1<a2) between the acceleration a1 at which to move the developer conveyance plate 14*b* in the developer conveyance direction J1 and the acceleration a2 at which to move the developer conveyance plate 14*b* in the developer counter-conveyance direction J2.

The developer container 14 further includes an opening member 14*c* having an opening 19 via which to discharge the toner 30 from the developer container 14. Thus, the developer conveyance plate 14*b*, which serves as a conveyance member, the opening member 14*c*, and the frame member 14*a* constitute a developer storage portion 14*t*, which stores the toner 30. The developer conveyance plate 14*b*, which serves as a conveyance member, is located at the lower end side of the opening 19.

The developer container 14 stores the toner 30 inside the developer storage portion 14*t*. The developer container 14 is connected to the developing device 10 via the opening member 14*c* coupled to the developer container 14, so that the developing chamber 10*i* of the developing device 10 and the developer storage portion 14*t* of the developer container 14 communicate with each other via the opening 19 of the opening member 14*c*. Thus, the process cartridge B according to the present exemplary embodiment is configured to include the drum unit 11, the developing device 10, and the developer container 14.

The developer conveyance plate 14*b*, to which the vibration of the vibration application member 13 is transmitted, vibrates alternately in the developer conveyance direction J1 and the developer counter-conveyance direction J2, to convey the toner 30, which is stored in the developer storage portion 14*t*, into the developing chamber 10*i* via the opening 19 of the opening member 14*c*.

<Image Forming Process>

Next, an image forming process performed by the process cartridge B is described with reference to FIGS. 1 and 2. Referring to FIG. 2, first, the photosensitive drum 7, which has a photosensitive layer, is rotated, and a charging bias voltage is applied to the charging roller 8, which serves as a charging unit, to uniformly charge the surface of the photosensitive drum 7.

Then, laser light 1*a* generated based on image information and radiated from the laser scanner 1 illustrated in FIG. 1 is thrown for scanning and exposure on the uniformly charged surface of the photosensitive drum 7 via the exposure opening 9*b* provided on the drum frame 11*d* of the process cartridge B. This causes an electrostatic latent image to be formed on the surface of the photosensitive drum 7.

Then, a developing bias voltage is applied to the developing roller 10*d* mounted in the developing device 10, and the toner 30, which serves as a developer, borne on the surface of the developing roller 10*d* is supplied to the electrostatic latent image formed on the surface of the photosensitive drum 7. This causes the electrostatic latent image formed on the surface of the photosensitive drum 7 to be developed into a visible toner image.

The developing device 10 supports the developing roller 10*d*, which serves as a developer bearing member that bears a developer, in such a way as to allow the developing roller 10*d* to rotate. In the present exemplary embodiment, as illustrated in FIG. 2, the developer conveyance plate 14*b*, which serves as a conveyance member, the opening 19, and the developing roller 10*d*, which serves as a developer bearing member, are arranged in this order from the upstream side to the downstream side in the developer conveyance direction J1 (in a direction from right to left in FIG. 2).

A toner layer to which frictional electrification charge has been applied by the developing blade 10*e* in conjunction with the rotation of the developing roller 10*d* is formed on the surface of the developing roller 10*d*. The toner 30 borne on the surface of the developing roller 10*d* is transferred to the electrostatic latent image on the surface of the photosensitive drum 7, so that a visible toner image is formed on the surface of the photosensitive drum 7.

Then, a transfer bias voltage with a polarity opposite that of the toner image on the surface of the photosensitive drum 7 is applied to the transfer roller 4 illustrated in FIG. 1. This causes the toner image on the surface of the photosensitive drum 7 to be transferred to the recording material 2. A toner 30 remaining on the surface of the photosensitive drum 7 after the toner image is transferred to the recording material 2 is scraped off by the cleaning blade 11*a*, which serves as a cleaning unit, fixed to the drum frame 11*d* at a fixing portion 11*h* illustrated in FIG. 2. Furthermore, the toner 30 scraped off by the cleaning blade 11*a* is scooped by the scooping sheet 11*b* and is then collected into the removed toner storage portion 11*c*.

<Developer Conveyance Device>

Figure 3:
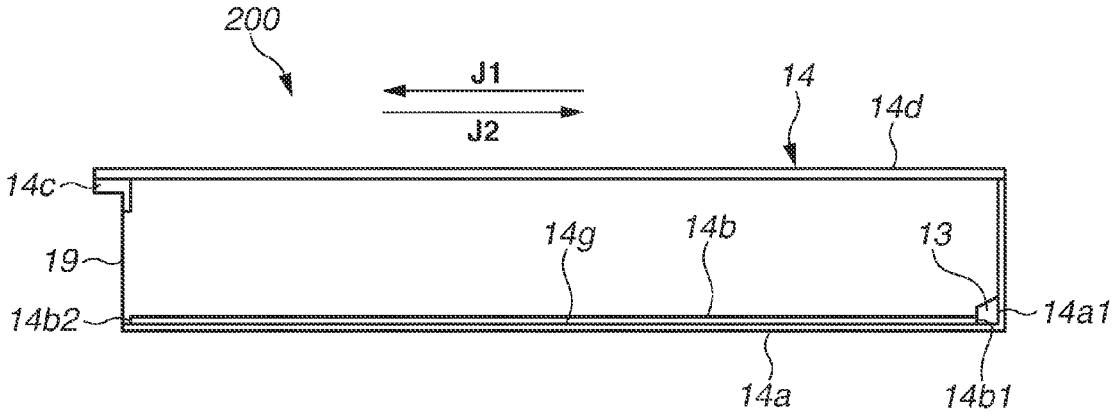
FIG. 3 is a sectional view illustrating a configuration of a developer conveyance device mounted in the developer container according to the first exemplary embodiment.

Next, a configuration of the developer conveyance device 200 is described with reference to FIGS. 2 to 4. FIG. 3 is a sectional view illustrating the configuration of the developer conveyance device 200. As illustrated in FIG. 3, the developer conveyance device 200 includes a developer container 14, which contains toner 30. The developer container 14 includes a frame member 14*a*, a developer conveyance plate 14*b*, and an opening member 14*c*. The developer container 14 further includes a vibration application member 13, which is configured to vibrate the developer conveyance plate 14*b* along the developer conveyance direction J1 and the developer counter-conveyance direction J2.

The developer conveyance plate 14*b* in the present exemplary embodiment is made from silicone rubber with a thickness of about 300 μm. The vibration application member 13 is composed of a piezoelectric actuator (piezoelectric element) that is capable of varying a vibration condition, such as a drive frequency, acceleration, or amplitude.

As illustrated in FIG. 2, the toner 30 inside the developer container 14 is supplied to the developing roller 10*d* via the opening 19. The developer conveyance plate 14*b* is located under the toner 30, and the vibration application member 13, which is composed of a piezoelectric actuator (piezoelectric element), is fixed to the end portion 14*b*1 of the developer conveyance plate 14*b* at the side that is farthest away from the opening 19 (at the right-hand side in FIG. 2).

Furthermore, on the other hand, the end portion 14*b*2 of the developer conveyance plate 14*b* at the side that is closest to the opening 19 (at the left-hand side in FIG. 2) is configured as a free end. The end portion 14*b*2 is opposite the end portion 14*b*1, to which the vibration application member 13 is fixed.

Reciprocating vibration in the developer conveyance direction J1 and the developer counter-conveyance direction J2 illustrated in FIG. 2 is applied by the vibration application member 13, which is fixed to the end portion 14*b*1 serving as a vibrated portion, to the developer conveyance plate 14*b*. The acceleration a1 generated by the vibration of the vibration application member 13, which acts in the developer conveyance direction J1 illustrated in FIG. 2, is set smaller than the acceleration a2, which acts in the developer counter-conveyance direction J2.

With this setting, when the developer conveyance plate 14*b* moves in the developer conveyance direction J1 illustrated in FIG. 2, the toner 30, serving as a developer, placed on the developer conveyance plate 14*b* moves integrally with the developer conveyance plate 14*b*. On the other hand, when the developer conveyance plate 14*b* moves in the developer counter-conveyance direction J2 illustrated in FIG. 2, the toner 30, serving as a developer, placed on the developer conveyance plate 14*b* slides on the developer conveyance plate 14*b* and moves in the developer conveyance direction J1 illustrated in FIG. 2 relative to the developer conveyance plate 14*b*.

Repeating such reciprocating vibration causes the toner 30, serving as a developer, placed on the developer conveyance plate 14*b* to be conveyed in the developer conveyance direction J1 illustrated in FIG. 2.

The conveyance speed of the toner 30 that is conveyed by the vibrating developer conveyance plate 14*b* in the developer conveyance direction J1 illustrated in FIG. 2 is as follows. The conveyance speed of the toner 30 can be changed as appropriate by the controller 50 controlling the vibrating operation of the vibration application member 13.

For example, the controller 50 changes a voltage that is applied to the electrodes provided at both end portions of the piezoelectric element of the vibration application member 13. This causes a change of the vibration frequency of the developer conveyance plate 14*b*, serving as a conveyance member (the vibration frequency of the vibration application member 13).

Alternatively, the controller 50 changes a voltage that is applied to the electrodes provided at both end portions of the piezoelectric element of the vibration application member 13. This causes a change of an acceleration difference between the acceleration a1, which acts in the developer conveyance direction J1 (forward path) on the vibrating developer conveyance plate 14*b*, serving as a conveyance member, and the acceleration a2, which acts in the developer counter-conveyance direction J2 (backward path).

Alternatively, the controller 50 changes a voltage that is applied to the electrodes provided at both end portions of the piezoelectric element of the vibration application member 13. This causes a change of the amplitude of the vibrating developer conveyance plate 14*b*, serving as a conveyance member.

In this way, various vibration parameters of the vibration application member 13 can be changed by the controller 50 changing a voltage that is applied to the electrodes provided at both end portions of the piezoelectric element of the vibration application member 13.

The vibration application member 13 is controlled by the CPU 52 via the controller 50 illustrated in FIG. 4. This enables freely controlling various vibration parameters of the vibrating developer conveyance plate 14*b* at desired timing.

<Developer Amount Detection Unit>

Next, a configuration of a developer amount detection unit (a detection unit) that detects the amount of a developer (the amount of toner) present near the developing roller 10*d*, serving as a developer bearing member, inside the developing device 10 is described with reference to FIGS. 1 and 2. The image forming apparatus 100 illustrated in FIG. 1 is provided with two developer amount detection units of respective different types.

The first developer amount detection unit is a developer remaining amount detection unit. The developer remaining amount detection unit detects the remaining amount of toner (the remaining amount of a developer) inside the developing device 10 (inside a developer container) based on a change of the amount of consumption of the toner 30 inside the developing device 10, which is consumed each time a toner image is formed on the recording material 2.

The second developer amount detection unit is a developer consumption amount detection unit. The developer consumption amount detection unit detects the amount of consumption of the toner 30 (the amount of consumption of a developer), which is consumed for each sheet of the recording material 2 each time a toner image is formed on the recording material 2.

<Developer Remaining Amount Detection Unit>

First, a configuration of the developer remaining amount detection unit is described with reference to FIGS. 2 and 4. The developer remaining amount detection unit measures the electrostatic capacitance between the developing roller 10*d* illustrated in FIG. 2 and an opposed plate 15 located a predetermined distance away from the developing roller 10*d*. This enables detecting the amount of a developer (the amount of toner) inside the developing chamber 10*i* of the developing device 10.

The opposed plate 15 is configured to have conductivity and has approximately the same length as the longitudinal length of the developing roller 10*d*. The opposed plate 15 in the present exemplary embodiment is made of a stainless (SUS) plate. As illustrated in FIG. 2, a resistor 16 is electrically connected between the opposed plate 15 and the ground G. A detection circuit 17 illustrated in FIG. 4 detects a voltage across both ends of the resistor 17 via a voltmeter 17*a* illustrated in FIG. 2.

During an image forming operation of the image forming apparatus 100 illustrated in FIG. 1, a developing bias voltage obtained by superposing a DC voltage and an AC voltage on each other is applied to the developing roller 10*d*. In the present exemplary embodiment, a developing bias voltage obtained by superposing a DC voltage of −300 V on an AC voltage with a peak-to-peak voltage of 1.6 kV and a frequency of 1.8 kHz is applied to the developing roller 10*d*.

With the developing bias voltage applied to the developing roller 10*d*, an electrostatic capacitance is generated according to the amount of toner 30, serving as a developer, present between the developing roller 10*d* and the opposed plate 15. Therefore, it can be considered that a capacitor is formed with the developing roller 10*d*, the opposed plate 15, and the toner 30 present between the developing roller 10*d* and the opposed plate 15.

The above-mentioned electrostatic capacitance is determined according to the amount of toner 30 present between the developing roller 10*d* and the opposed plate 15. Then, when the amount of toner 30 present between the developing roller 10*d* and the opposed plate 15 decreases in association with the decrease of the amount of toner 30 inside the process cartridge B, the electrostatic capacitance varies. The variation of the electrostatic capacitance can be detected as a change of the output voltage across both ends of the resistor 16 illustrated in FIG. 2. Data on the output voltage across both ends of the resistor 16, which is measured by the voltmeter 17*a* provided in the detection circuit 17, is sent to the CPU 52 illustrated in FIG. 4.

The CPU 52, which serves as a control unit, previously stores the following data table in a random access memory (RAM) 12, which serves as a storage unit, illustrated in FIG. 4. The data table contains data obtained by experimentally finding the relationship between the output voltage value across both ends of the resistor 16 and the amount of toner 30 inside the developing chamber 10*i*. The amount of toner 30 inside the developing chamber 10*i* can be detected based on the data table.

<Developer Consumption Amount Detection Unit>

Next, a configuration of the developer consumption amount detection unit is described with reference to FIGS. 1 and 4. The amount of consumption of a developer that is consumed by the image forming operation of the image forming apparatus 100 can be estimated based on image data that is input from an input device, such as a personal computer, via the interface unit 51. The image data input from the input device is sent to the CPU 52 illustrated in FIG. 4 and is then converted into the number of pixels.

The CPU 52 is able to calculate and estimate the amount of consumption of toner 30 that is consumed for each sheet of the recording material 2 each time a toner image is formed on the recording material 2, based on the number of pixels, into which the image data has been converted, and the amount of consumption of toner 30 that is consumed for each pixel, which is previously stored in the RAM 12. The CPU 52 and the RAM 12 also serve as a detection unit that detects the amount of a developer present near the developing roller 10*d*, which serves as a developer bearing member.

<Setting of Vibration Condition Using Developer Amount Detection Result>

Figure 6:
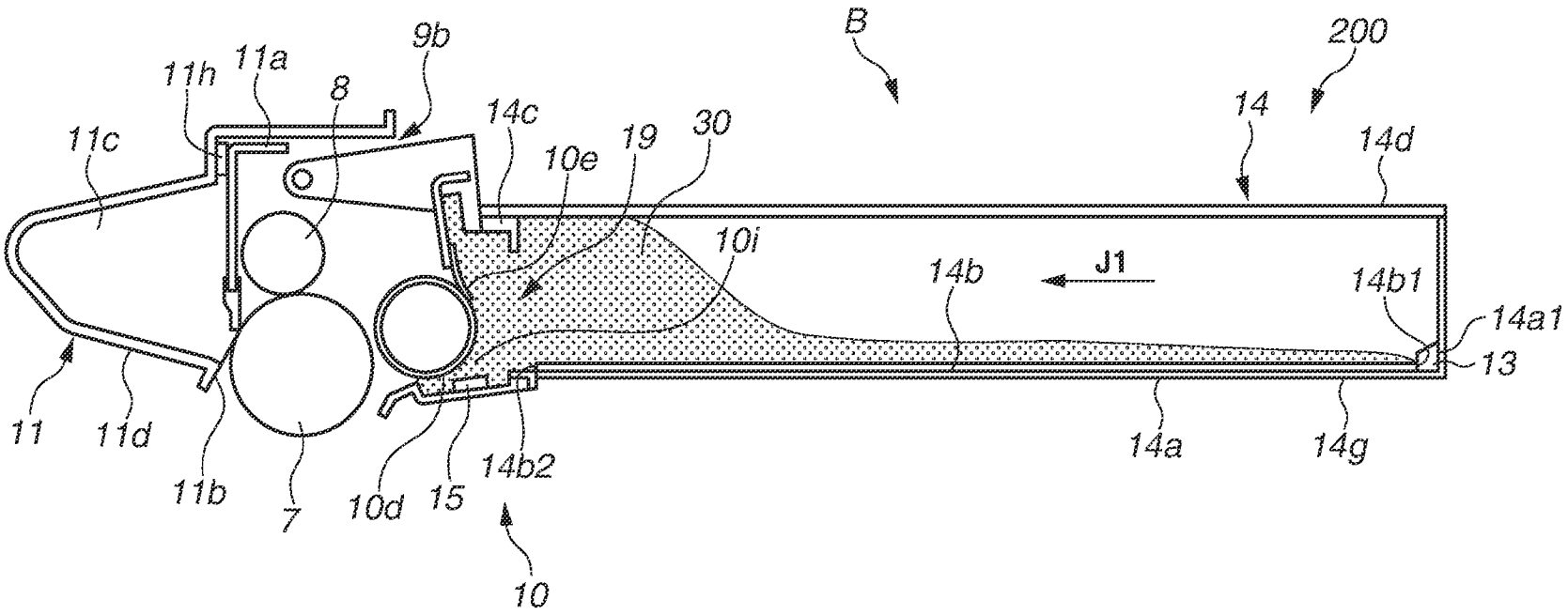
FIG. 6 is a sectional view illustrating a state in which the toner amount in the developing chamber of the developing device and the powder pressure of the developer are excessive in the first exemplary embodiment.
Figure 7:
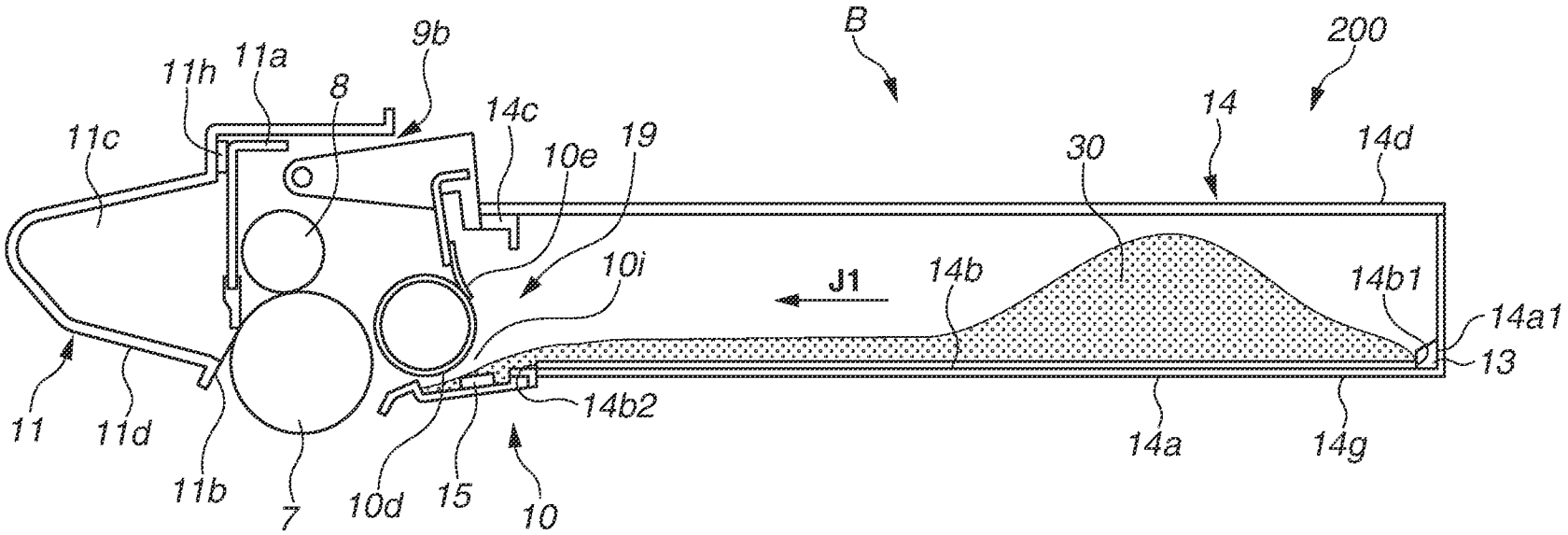
FIG. 7 is a sectional view illustrating a state in which the toner amount in the developing chamber of the developing device is too small in the first exemplary embodiment.

Next, a configuration of the controller 50, serving as a control unit, which controls the conveyance amount of a developer that is conveyed by the developer conveyance plate 14*b*, serving as a conveyance member, by controlling the vibrating operation of the vibration application member 13 using developer amount detection results obtained by the above-mentioned developer remaining amount detection unit and developer consumption amount detection unit is described with reference to FIGS. 5 to 7.

The controller 50 (the CPU in this case) is configured as an adjustment unit that is capable of adjusting a vibration condition of the developer conveyance plate 14*b*, which serves as a conveyance member. Thus, the controller 50 adjusts the vibration condition of the developer conveyance plate 14*b*, which serves as a conveyance member, according to a result of detection by a detection unit that detects the amount of a developer inside the developer container 14. The CPU serves as a detection unit and an adjustment unit in this case, but is not limited to such units.

When the image forming operation is performed on the recording material 2 by the image forming apparatus 100 illustrated in FIG. 1, the toner 30 conveyed in the developer conveyance direction J1 illustrated in FIG. 5 by the vibration of the developer conveyance plate 14*b*, which constitutes the bottom surface of the developer container 14, sequentially flows into the developing chamber 10*i* via the opening 19.

On the other hand, the toner 30 present inside the developing chamber 10*i* sequentially flows out due to the consumption of toner associated with the image forming operation. At this time, in order to maintain the state in which the toner 30 is supplied to the developing roller 10*d* without any delay, it is desirable that the amount of toner 30 inside the developing chamber 10*i* and the powder pressure of toner 30, which is composed of particulates, are kept appropriate.

Furthermore, conditions for keeping the amount of toner 30 inside the developing chamber 10*i* and the powder pressure of the toner 30 appropriate vary with various conditions, such as the configuration of the developing device 10, the type of toner 30, and the use history of toner 30.

FIG. 5 is a sectional view illustrating the state in which the amount of toner 30 inside the developing chamber 10*i* and the powder pressure of the toner 30 are appropriate. In the state illustrated in FIG. 5, the inflow of toner 30 into the developing chamber 10*i* and the outflow of toner 30 from the developing chamber 10*i* are well balanced, and the amount of toner 30 inside the developing chamber 10*i* and the powder pressure of the toner 30 are kept appropriate.

FIGS. 6 and 7 each illustrate the state in which the inflow of toner 30 into the developing chamber 10*i* and the outflow of toner 30 from the developing chamber 10*i* are badly balanced. FIG. 6 illustrates an example of a state in which the amount of toner 30 that flows into the developing chamber 10*i* has become excessive relative to the amount of toner 30 that flows out from the developing chamber 10*i*. In the state illustrated in FIG. 6, the powder pressure of toner 30 inside the developing chamber 10*i* has become higher than the powder pressure of toner 30 inside the developing chamber 10*i* in the appropriate state illustrated in FIG. 6.

When the state illustrated in FIG. 6 continues, the toner 30 inside the developing chamber 10*i* is pressed and solidified by the powder pressure, so that particles of the toner 30 become congested. Therefore, since the fluidity of toner 30 as particles is impaired, the supply of toner 30 to the developing roller 10*d* becomes insufficient, so that a reduced density or a blank area, in which an image is left white, may occur at the position where the supply of toner 30 is insufficient on a toner image formed on the recording material 2.

FIG. 7 illustrates an example of a state in which the amount of toner 30 that flows into the developing chamber 10*i* has become insufficient relative to the amount of toner 30 that flows out from the developing chamber 10*i*. In the state illustrated in FIG. 7, the amount of toner 30 inside the developing chamber 10*i* is smaller than the amount of toner 30 inside the developing chamber 10*i* in the appropriate state illustrated in FIG. 5. Therefore, the supply of toner 30 to the developing roller 10*d* has become insufficient. Also in this case, a reduced density or a blank area, in which an image is left white, may occur at the position where the supply of toner 30 is insufficient on a toner image formed on the recording material 2.

The amount of toner 30 in the image forming apparatus 100 changes every moment according to the image forming operation. Additionally, the amount of consumption of toner 30 for each sheet of the recording material 2 changes for each toner image formed on the recording material 2. In the present exemplary embodiment, the amount of toner 30 inside the developing chamber 10*i* and the powder pressure of the toner 30 are kept always appropriate as in the state illustrated in FIG. 5.

More specifically, the amount of toner 30 inside the developing chamber 10*i* and the powder pressure of the toner 30 are estimated by the above-mentioned developer remaining amount detection unit and developer consumption amount detection unit, and the vibration of the developer conveyance plate 14*b*, which is vibrated by the vibration application member 13, is controlled based on a result of the estimation. With this, the amount of inflow of toner 30 into the developing chamber 10*i* is controlled. This enables maintaining balance between the amount of toner 30 that flows into the developing chamber 10*i* and the amount of toner 30 that flows out from the developing chamber 10*i*.

<Control Unit>

FIG. 4 is a block diagram illustrating a configuration of the control unit. The CPU 52 processes image data that is sent from the interface unit 51 and a measured value of electrostatic capacitance corresponding to the amount of toner 30 present between the developing roller 10*d* and the opposed plate 15, which is sent from the detection circuit 17. Then, the CPU 52 converts the image data and the measured value of electrostatic capacitance into an estimated value of consumption amount of toner 30 for each toner image formed on the recording material 2 and the amount of a developer inside the developing device 10.

The CPU 52 selects an appropriate vibration condition of the vibration application member 13 corresponding to any one or both of the estimated value of consumption amount of toner 30 and the amount of a developer inside the developing device 10. Then, the CPU 52 adjusts, via the controller 50, the vibration condition of the vibration application member 13 in such a manner that the developer conveyance plate 14*b* is vibrated on a desired condition.

<Experiment 1: Case where Only Developer Consumption Amount Detection Result is Used>

An experiment for performing printing on the recording material 2 with 1,200 sheets of A4 size using the image forming apparatus 100 according to the present exemplary embodiment was conducted. In the present experiment, as illustrated in FIG. 8, images having such respective different patterns as a coverage rate of 30% (an image (1) in FIG. 8), a coverage rate of 5% (an image (2) in FIG. 8), and a coverage rate of 1% (an image (3) in FIG. 8) were used. Here, the term "coverage rate" refers to the ratio of the number of pixels actually used for image formation to the total number of pixels present within the range of A4 size.

In the present experiment, the images (1) to (3) having respective different patterns were switched for every 50 sheets of the recording material 2 in the order of the image (1), the image (2), and the image (3), and printing on 150 sheets of the recording material 2 in total was set as one cycle of print job. This print job was repeated eight cycles as illustrated in FIG. 8, and image formation was performed on 1,200 sheets of the recording material 2 in total with an intermittent operation performed for every two sheets of the recording material 2. In the middle of printing, each time one cycle of print job was complete, a full-page solid image was printed to determine whether a reduced density or a blank area occurred.

In the present experiment, the coverage rate for printing on each sheet was calculated by the above-mentioned developer consumption amount detection unit. Then, the vibration condition of the vibration application member 13 for printing on a subsequent sheet was adjusted based on the coverage rate for printing on an immediately preceding sheet. The number of sheets set forth in the second column from the right in FIG. 8 indicates the number of sheets of the recording material 2 on which printing was performed after the vibration condition of the vibration application member 13 was adjusted based on the coverage rate for printing on an immediately preceding sheet. Here, the controller 50 adjusted a vibration frequency in the vibration condition of the vibration application member 13.

Furthermore, it was revealed by the study made by the inventor of the present invention that, in the configuration according to the present exemplary embodiment, when the vibration frequency of the vibration application member 13 was in the range of 0 Hz to 40 Hz, as the vibration frequency was higher, the performance of conveyance of toner 30 by the vibrating developer conveyance plate 14*b* became higher. Moreover, with regard to the vibration condition other than the vibration frequency, the acceleration a1 in the developer conveyance direction J1 (forward path) in the reciprocating vibration of the developer conveyance plate 14*b* was set to 10 m/sec$^2$.

Furthermore, the acceleration a2 in the developer counter-conveyance direction J2 (backward path) in the reciprocating vibration of the developer conveyance plate 14*b* was set to 15 m/sec$^2$. As a result of this, the acceleration difference in the reciprocating movement of the developer conveyance plate 14*b* was 5 m/sec$^2$ (=15 m/sec$^2$−10 m/sec$^2$). The amplitude of the developer conveyance plate 14*b* was set to 0.8 mm.

As illustrated in FIG. 8, with regard to a subsequent sheet of the recording material 2 on which the image (1) with a coverage rate of 30% was printed, the vibration frequency of the vibration application member 13 was set to 40 Hz. With regard to a subsequent sheet of the recording material 2 on which the image (2) with a coverage rate of 5% was printed, the vibration frequency of the vibration application member 13 was set to 10 Hz. With regard to a subsequent sheet of the recording material 2 on which the image (3) with a coverage rate of 1% was printed, the vibration frequency of the vibration application member 13 was set to 2 Hz. As the amount of outflow of a developer from the developing chamber 10*i* is larger, the vibration frequency of the vibration application member 13 was set higher and the amount of conveyance of toner 30 was set larger. Throughout the present experiment, neither a reduced density nor a blank area occurred in a toner image formed on the recording material 2.

<Experiment 2: Combination Use of Developer Consumption Amount Detection Result and Developer Remaining Amount Detection Result>

In the above-described experiment 1, only the developer consumption amount detection unit was used as a detection unit that detected the amount of toner 30 inside the developing chamber 10*i* and the powder pressure of the toner 30. In the present experiment 2, the developer remaining amount detection unit was also used in addition to the developer consumption amount detection unit. This enables keeping the amount of toner 30 inside the developing chamber 10*i* and the powder pressure of the toner 30 appropriate.

For example, referring to FIG. 8, the amount of toner 30 inside the developing device 10 greatly differs between the first cycle and the eighth cycle of print job. When the print job reaches the eighth cycle, the toner 30 inside the developing device 10 has been considerably consumed. Therefore, the amount of toner 30 inside the developing device 10 in the eighth cycle is smaller than in the first cycle. Accordingly, even when the coverage rate is the same, the optimum vibration condition differs between the first cycle and the eighth cycle of print job.

More specifically, as the amount of toner 30 on the developer conveyance plate 14*b* is smaller, the conveyance speed becomes lower. Therefore, even when the coverage rate is the same, the vibration frequency of the vibration application member 13 is set higher in the eighth cycle of print job, in which the amount of toner 30 is smaller, than in the first cycle of print job.

Here, the amount of a developer is detected by the developer consumption amount detection unit and the developer remaining amount detection unit, both of which serve as a detection unit. The experiment 2 illustrated in FIG. 9 was conducted based on values calculated from combinations of a developer consumption amount detection result and a developer remaining amount detection result detected by the above-mentioned detection units. The method of the experiment 2 was similar to that of the experiment 1. Referring to FIG. 9, the third column from the right indicates a result of detection of the remaining amount of toner (toner amount) inside the developing device 10, which was measured each time printing was performed on 50 sheets of the recording material 2.

Referring to FIG. 9, a comparison is now made between the second cycle and the eighth cycle of print job. The remaining amount of toner inside the developing device 10 when the second cycle of print job was started was 92 g (the remaining amount of toner when the first cycle of print job was complete). Based on this result, the vibration frequency of the vibration application member 13 when printing was performed on the 151st sheet to the 200th sheet of the recording material 2 was set to 40 Hz.

On the other hand, the remaining amount of toner inside the developing device 10 when the eighth cycle of print job was started was 44 g (the remaining amount of toner when the seventh cycle of print job was complete). As compared with when the second cycle of print job was started, the amount of toner 30 decreased by 48 g (=92 g−44 g). Therefore, in consideration of the decrease of the amount of toner 30 inside the developing device 10, the vibration frequency of the vibration application member 13 when printing was performed on the 1051st sheet to the 1100th sheet of the recording material 2 was set to 45 Hz, which was 5 Hz higher than 40 Hz, which was set when the second cycle of print job was started. Throughout the present experiment, neither a reduced density nor a blank area occurred in a toner image formed on the recording material 2.

Here, in the above-described experiments 1 and 2, the vibration frequency of the vibration application member 13 was adjusted as the vibration condition of the developer conveyance plate 14*b*. Additionally, another vibration condition can be adjusted as long as it is a vibration condition that affects the conveyance property of toner. For example, the acceleration difference between the acceleration a1 in the developer conveyance direction J1 (forward path) and the acceleration a2 in the developer counter-conveyance direction J2 (backward path) during the reciprocating movement of the developer conveyance plate 14*b* or the amplitude of the developer conveyance plate 14*b* can be adjusted.

During the reciprocating movement of the developer conveyance plate 14*b*, a low acceleration is set for the developer conveyance direction J1 (forward path) so that the toner 30 and the developer conveyance plate 14*b* slide on each other as little as possible, and a high acceleration is set for the developer counter-conveyance direction J2 (backward path) so that the toner 30 and the developer conveyance plate 14*b* slide on each other. This leaves the toner 30 at the destination to which the toner 30 has been conveyed in association with the movement of the developer conveyance plate 14*b* in the developer conveyance direction J1 (forward path). Repeating this operation is the principle of conveyance of toner 30 using the reciprocating vibration of the developer conveyance plate 14*b*. This is the reason why the acceleration difference between the acceleration a1 in the developer conveyance direction J1 (forward path) and the acceleration a2 in the developer counter-conveyance direction J2 (backward path) affects the performance of conveyance of toner 30.

According to the present exemplary embodiment, when a developer is conveyed by the vibration of the developer conveyance plate 14*b*, the balance between the speed of inflow of a developer into the developing chamber 10*i* and the speed of outflow of a developer from the developing chamber 10*i* can be kept always optimum, so that a good image can be formed in such a manner that neither a reduced density nor a blank area occurs in a toner image formed on the recording material 2.

Next, a configuration of an image forming apparatus to which a process cartridge equipped with a developing device including a developer container is detachably attached according to a second exemplary embodiment of the present invention is described with reference to FIGS. 10 and 11. Furthermore, components configured similar to those in the first exemplary embodiment are assigned the respective same reference numerals, or are assigned the respective same component names even if different reference numerals are used, and the description thereof is not repeated.

In the second exemplary embodiment, in controlling the amount of conveyance of a developer that is conveyed by the developer conveyance plate 14*b*, which serves as a conveyance member, by controlling the vibrating operation of the vibration application member 13 via the controller 50, which serves as a control unit, the performance of conveyance of toner 30 itself is also taken into consideration.

<Vibration Control with Performance of Conveyance of Toner 30 Itself Taken into Consideration>

Repeating the use of toner 30 inside the developing device 10 generally results in a gradual decrease in fluidity. Then, the fluidity affects the performance of conveyance of toner 30. With regard to the same toner 30, as the repetitive use thereof causes a decrease in fluidity, the performance of conveyance by the vibrating developer conveyance plate 14*b* improves.

In the second exemplary embodiment, a decrease in fluidity due to the repetitive use is estimated based on the use history of toner 30 using information on the rotation time of the developing roller 10*d*, and a result of the estimation is reflected in the adjustment of the vibration condition of the developer conveyance plate 14*b*.

The rotation time of the developing roller 10*d* can be grasped by being stored in the random access memory (RAM) 12. A period of time for which the central processing unit (CPU) 52 continues issuing, to the controller 50, a rotation instruction for a motor 10*d*1, which serves as a drive source that rotationally drives the developing roller 10*d*, is set as the rotation time of the developing roller 10*d*. The CPU 52 and the RAM 12 also serve as a second detection unit that detects the performance of conveyance of a developer.

As the rotation time of the developing roller 10*d* is longer, the fluidity of toner 30 inside the developing device 10 more decreases, so that the performance of conveyance of toner 30 by the vibration of the developer conveyance plate 14*b* more improves. Accordingly, the controller 50 changes a voltage to be applied to the electrodes provided at both end portions of the piezoelectric element of the vibration application member 13. With this, the vibrating operation of the vibration application member 13 is controlled in such a way as to reduce the amount of conveyance of toner 30 caused by the vibration of the developer conveyance plate 14*b*.

<Control Unit>

Figure 10:
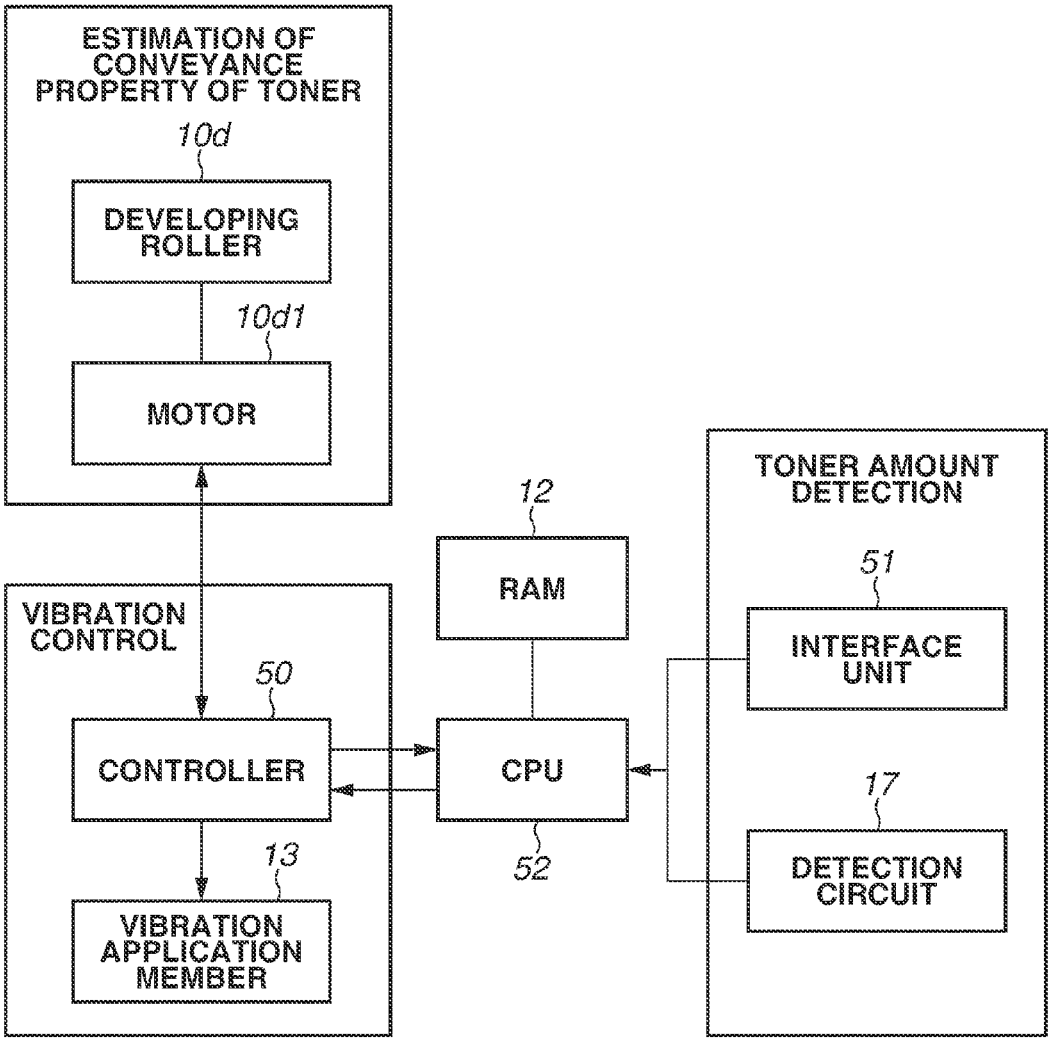
FIG. 10 is a block diagram illustrating a configuration of a control system in the image forming apparatus to which the process cartridge equipped with the developing device including the developer container is detachably attached according to a second exemplary embodiment of the present invention.

FIG. 10 is a block diagram illustrating a configuration of the control unit according to the second exemplary embodiment. The following are differences from the configuration of the control unit in the above-described first exemplary embodiment illustrated in FIG. 4. The rotation time of the motor 10*d*1, which rotationally drives the developing roller 10*d*, is used as information on estimation of the conveyance property of toner 30. The rotation time of the motor 10*d*1 is continuously sent to the CPU 52 via the controller 50. In the second exemplary embodiment, information on the rotation time of the motor 10*d*1 is fed back to the control of vibration of the developer conveyance plate 14*b*. The configuration in which the control of vibration of the developer conveyance plate 14*b* is performed using developer consumption amount detection information or developer remaining amount detection information, or both of the developer consumption amount detection information and the developer remaining amount detection information, is similar to the configuration in the above-described first exemplary embodiment, and the description thereof is, therefore, not described again.

<Experiment 3>

An experiment 3 was conducted using the image forming apparatus 100 to which the adjustment of vibration of the developer conveyance plate 14*b* according to the second exemplary embodiment was applied. The method of the experiment 3 was similar to that of the above-described experiment 1, and is, therefore, not described again.

The third column from the right illustrated in FIG. 11 indicates a cumulative rotation time of the developing roller 10*d* obtained each time printing has been performed on 50 sheets of the recording material 2. A comparison is now made between the second cycle and the eighth cycle of print job with reference to FIG. 11. The rotation time of the developing roller 10*d* obtained when the second cycle of print job was started was 600 seconds (the rotation time of the developing roller 10*d* obtained when the first cycle of print job was complete). Based on this result, the vibration frequency of the vibration application member 13 when printing was performed on the 152nd sheet to the 201st sheet of the recording material 2 was set to 40 Hz.

On the other hand, the rotation time of the developing roller 10*d* obtained when the eighth cycle of print job was started was 4,200 seconds (the rotation time of the developing roller 10*d* obtained when the seventh cycle of print job was complete). As compared with when the second cycle of print job was started, the rotation time of the developing roller 10*d* increased by 3,600 seconds (=4,200 seconds−600 seconds), so that a decrease of fluidity of toner 30 was supposed.

Therefore, in consideration of the decrease of fluidity of toner 30, the vibration frequency of the vibration application member 13 when printing was performed on the 1052nd sheet to the 1101st sheet of the recording material 2 was set to 38 Hz, which was 2 Hz lower than 40 Hz, which was set when the second cycle of print job was started. Throughout the present experiment, neither a reduced density nor a blank area occurred in a toner image formed on the recording material 2.

Furthermore, in the second exemplary embodiment, the rotation time of the developing roller 10*d* is used as a factor for determining the conveyance property of toner 30 itself. Additionally, it is conceivable that, for example, the rotation time of the photosensitive drum 7, which serves as an image bearing member, or a variety of detection units that directly detect the fluidity of toner 30 can be used.

Furthermore, also in the second exemplary embodiment, as in the above-described exemplary embodiment, the vibration frequency of the vibration application member 13, which is an example of the vibration condition of the developer conveyance plate 14*b*, is adjusted. Besides, the above-mentioned various vibration conditions can be adjusted as long as those are vibration conditions that affect the conveyance property of toner 30. The other configurations in the second exemplary embodiment are similar to those in the first exemplary embodiment, so that the same advantageous effect can be obtained.

In the above-described first and second exemplary embodiments, even when the amount of toner 30 inside the developing device 10 changes every moment or even when the consumption amount of toner 30 changes each time printing is performed on the recording material 2, such a change is detected and the vibration condition of the developer conveyance plate 14*b* is adjusted as appropriate according to a result of the detection. This enables keeping the amount of toner 30 inside the developing chamber 10*i* and the powder pressure of the toner 30 always appropriate. Accordingly, a good image without any image defect, such as a reduced density or a blank area, in a toner image formed on the recording material 2 can be constantly provided.

Next, a configuration of an image forming apparatus to which a process cartridge equipped with a developing device including a developer container is detachably attached according to a third exemplary embodiment of the present invention is described with reference to FIG. 12. Furthermore, components configured similar to those in the first and second exemplary embodiments are assigned the respective same reference numerals, or are assigned the respective same component names even if different reference numerals are used, and the description thereof is not repeated.

In the third exemplary embodiment, a control unit that controls the amount of conveyance of a developer that is conveyed by the developer conveyance plate 14*b*, which serves as a conveyance member, is configured as follows. As illustrated in FIG. 12, a restriction member 14*e* with a long plate-like shape along the longitudinal direction of the developing roller 10*d* is rotatably supported around a rotation shaft 14*f* by a cover member 14*d* fitted in the frame member 14*a* of the developer container 14.

A contact portion 14*e*1 of the restriction member 14*e*, which protrudes outside the developer container 14, is locked by contacting a positioning boss 18, which serves as a positioning unit, movably mounted on an apparatus frame of the body of the image forming apparatus 100. This controls the turning angle 8 of a blocking portion 14*e*2 of the restriction member 14*e*, which is inserted into the developer storage portion 14*t* of the developer container 14.

Figure 12:
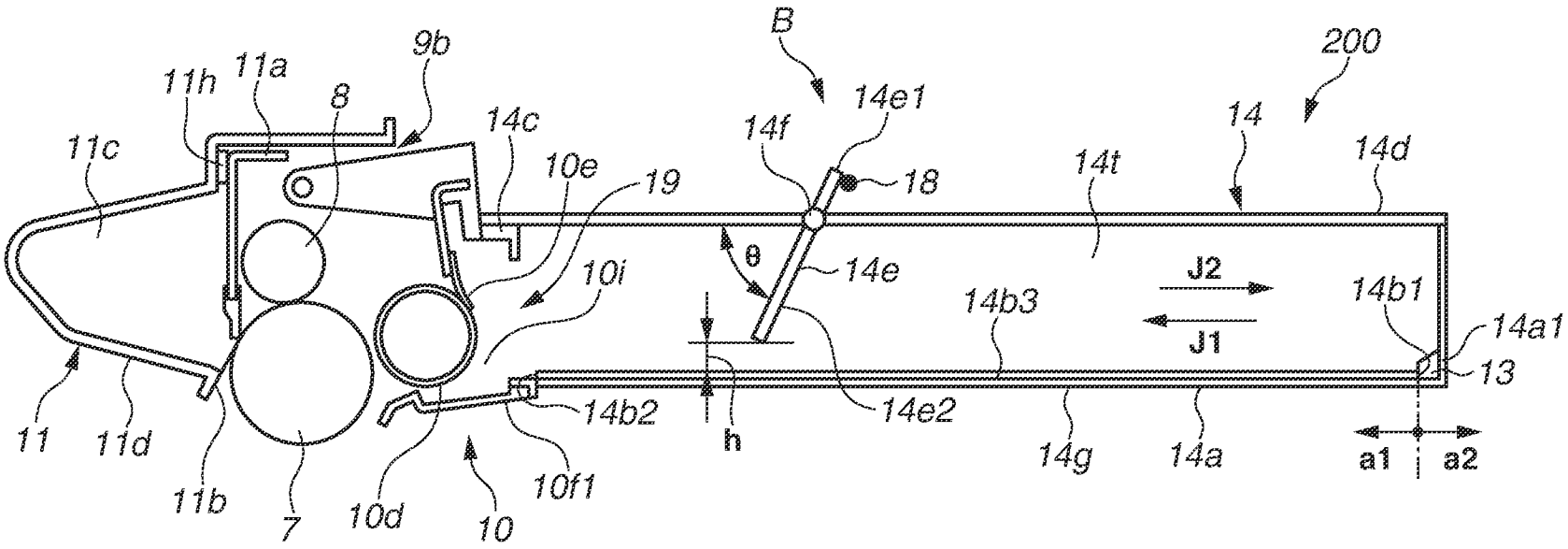
FIG. 12 is a sectional view illustrating a configuration of a process cartridge equipped with a developing device including a developer container according to a third exemplary embodiment of the present invention.

A torsion coil spring (not illustrated) is fitted around the rotation shaft 14*f* of the restriction member 14*e*, and the restriction member 14*e* is constantly urged by the torsion coil spring clockwise as viewed in FIG. 12 around the rotation shaft 14*f*. The positioning boss 18, which is movably mounted on the apparatus frame of the body of the image forming apparatus 100, contacts and supports the contact portion 14*e*1 against the urging force of the torsion coil spring.

When the restriction member 14*e* is held in the state illustrated in FIG. 12, a developer, which is conveyed by the developer conveyance plate 14*b* serving as a conveyance member, is blocked by contacting the blocking portion 14*e*2. This allows a developer, which is conveyed by the developer conveyance plate 14*b*, to be conveyed in the developer conveyance direction J1 only from a space h between the upper surface 14*b*3 of the developer conveyance plate 14*b* and the lower end of the blocking portion 14*e*2.

The restriction member 14*e* is positioned by the positioning boss 18, which serves as a positioning unit, in such a manner that the turning position of the restriction member 14*e* is changeable. The positioning boss 18 is configured to be movable by a movement unit (not illustrated) that is controlled by the controller 50. The other configurations in the third exemplary embodiment are similar to those in the first and second exemplary embodiments, so that the same advantageous effect can be obtained.

Next, a configuration of an image forming apparatus to which a process cartridge equipped with a developing device including a developer container is detachably attached according to a fourth exemplary embodiment of the present invention is described with reference to FIGS. 13A and 13B. Furthermore, components configured similar to those in the first, second, and third exemplary embodiments are assigned the respective same reference numerals, or are assigned the respective same component names even if different reference numerals are used, and the description thereof is not repeated.

In the fourth exemplary embodiment, a control unit that controls the amount of conveyance of a developer that is conveyed by the developer conveyance plate 14*b*, which serves as a conveyance member, is configured as follows. As illustrated in FIGS. 13A and 13B, the developer conveyance plate 14*b*, which serves as a conveyance member, is supported on the bottom plate 14*g* of the frame member 14*a* of the developer container 14 in such a way as to be movable both in the developer conveyance direction J1 and in the developer counter-conveyance direction J2, which is opposite the developer conveyance direction J1.

Figure 13A:
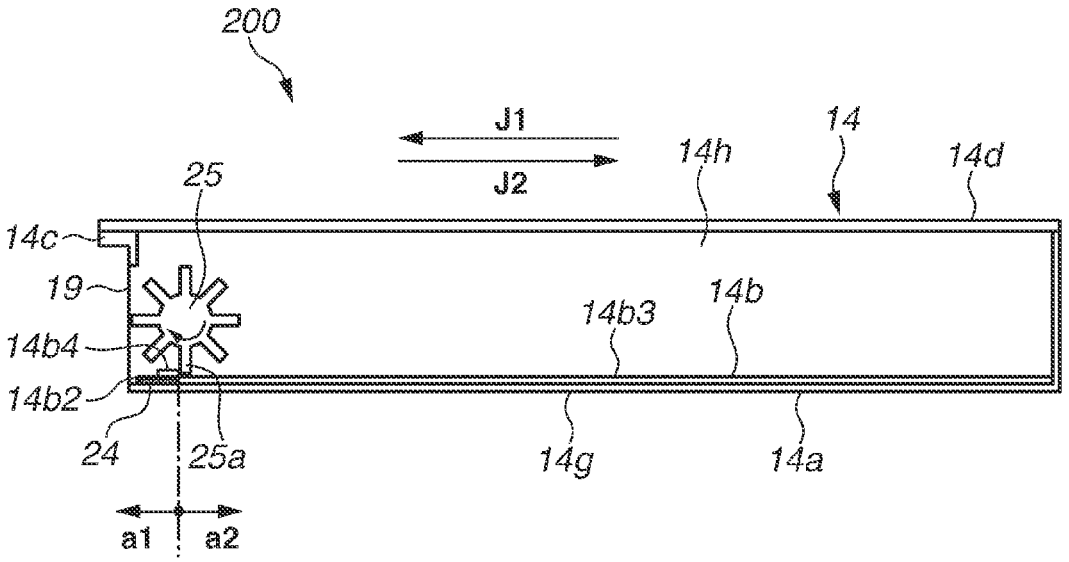
FIG. 13A is a sectional view illustrating a configuration of a process cartridge equipped with a developing device including a developer container according to a fourth exemplary embodiment of the present invention.
Figure 13B:
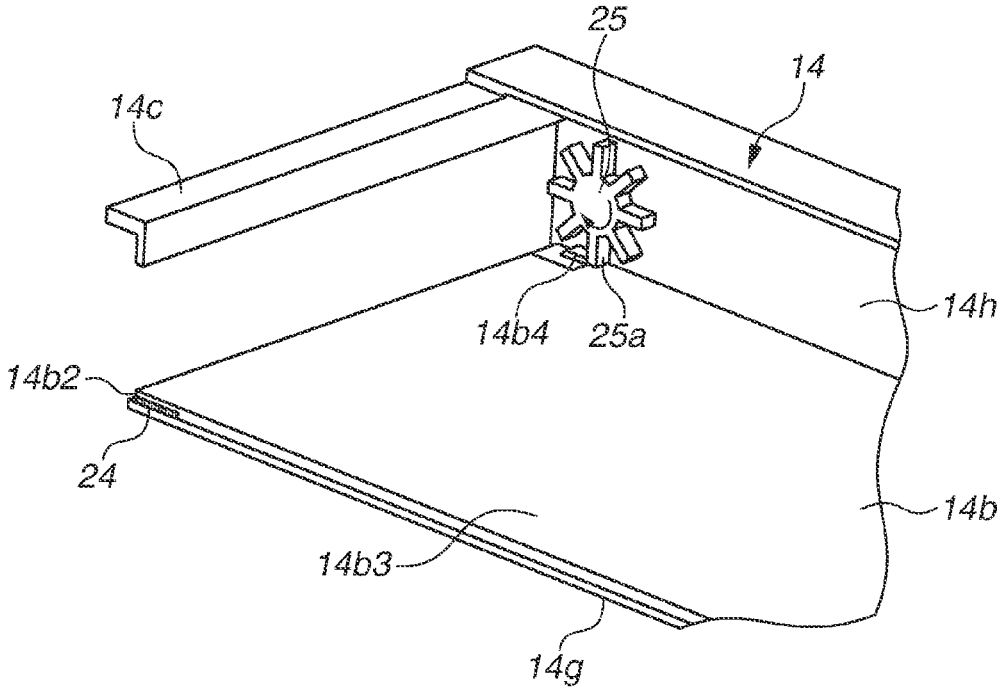
FIG. 13B is a perspective view of FIG. 13A.
Figure 14:
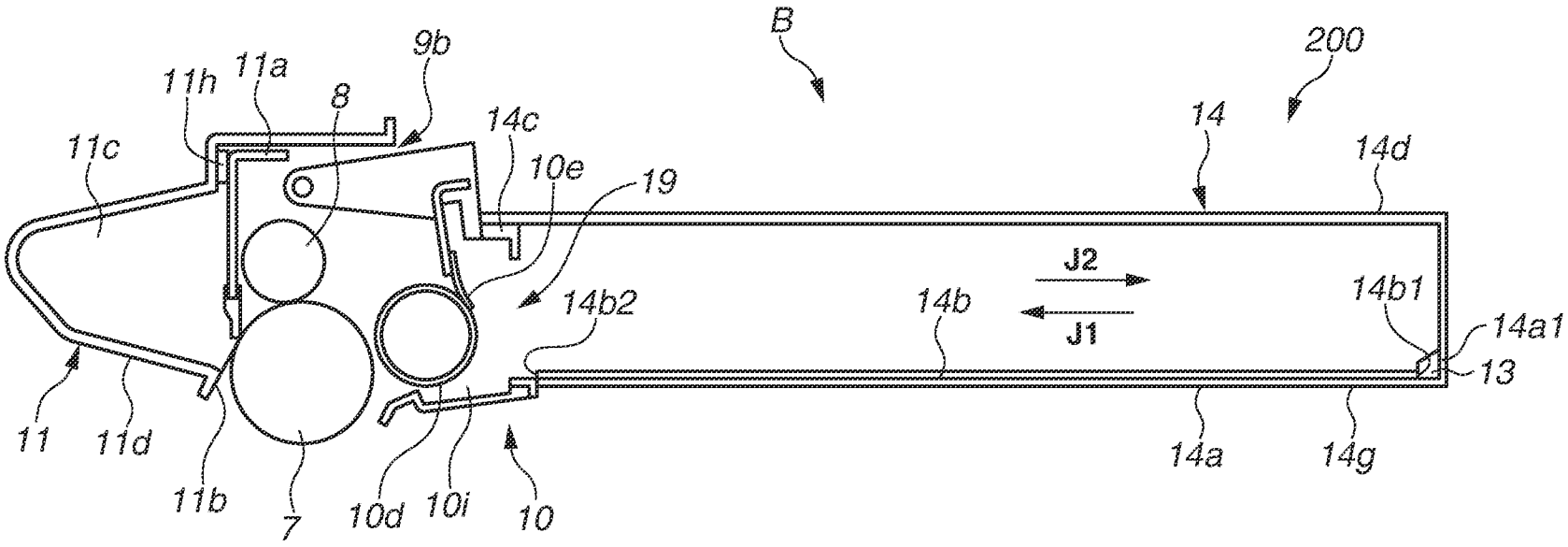
FIG. 14 is a sectional view illustrating a configuration of a process cartridge, serving as a comparative example, which is detachably attached to an image forming apparatus.

An urging member 24, which is composed of a coil spring, is mounted on the lower surface of the left-hand end portion 14*b*2, as viewed in FIGS. 13A and 13B, of the developer conveyance plate 14*b*. The urging member 24 exerts stretching force to constantly urge the developer conveyance plate 14*b* in the developer counter-conveyance direction J2, which is opposite the developer conveyance direction J1 illustrated in FIG. 13A.

A contact portion 14*b*4, which serves as a vibrated portion, protruding from the upper surface 14*b*3 of the developer conveyance plate 14*b* is mounted on the upper surface of the left-hand end portion 14*b*2, as viewed in FIGS. 13A and 13B, of the developer conveyance plate 14*b*. A rotary member 25 having a plurality of contact portions 25*a* is pivotally supported on a side plate 14*h* of the frame member 14*a* of the developer container 14. The plurality of contact portions 25*a* in the fourth exemplary embodiment is composed of eight contact portions located at positions shifted at intervals of 45 degrees in the radial direction from the rotational center of the rotary member 25.

The rotary member 25 is rotated, under the control of the controller 50, by a motor (not illustrated), which serves as a drive source, mounted in the body of the image forming apparatus 100 via a drive gear train. When the rotary member 25 is rotated clockwise as viewed in FIGS. 13A and 13B, the plurality of contact portions 25*a* sequentially and periodically contacts the contact portion 14*b*4, which serves as a vibrated portion, protruding from the upper surface 14*b*3 of the developer conveyance plate 14*b*. This presses the developer conveyance plate 14*b* in the developer conveyance direction J1 against the urging force of the urging member 24.

The controller 50, which serves as a control unit, controls the rotating operation of the rotary member 25 to control the amount of conveyance of a developer that is conveyed by the developer conveyance plate 14*b*. For example, an acceleration a2 that acts on the developer conveyance plate 14*b* in the developer counter-conveyance direction J2 illustrated in FIG. 13A due to the stretching force of the urging member 24 is taken into consideration. Furthermore, an acceleration a1 that acts on the developer conveyance plate 14*b* when the rotary member 25 rotates to cause each contact portion 25*a* to contact the contact portion 14*b*4 is also taken into consideration. The acceleration a2 in the developer counter-conveyance direction J2 is set larger than the acceleration a1 in the developer conveyance direction J1. This causes a developer placed on the upper surface 14*b*3 of the developer conveyance plate 14*b* to move in the developer conveyance direction J1. The other configurations in the fourth exemplary embodiment are similar to those in the first, second, and third exemplary embodiments, so that the same advantageous effect can be obtained.

According to exemplary embodiments of the present invention, the balance between the inflow and outflow of a developer when the developer is conveyed by vibration can be kept.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-065553 filed Mar. 27, 2015, which is hereby incorporated by reference herein in its entirety.

What is claimed is:

1. An image forming apparatus comprising:

a frame configured to contain developer;

a conveyance member configured to convey the developer by vibration;

a detection unit configured to detect a developer amount of the developer inside the frame; and an adjustment unit configured to adjust the vibration of the conveyance member, wherein the adjustment unit adjusts the vibration of the conveyance member according to a result of detection by the detection unit.

2. The image forming apparatus according to claim 1, wherein the conveyance member includes:

a developer conveyance plate supported to be movable both in a developer conveyance direction, in which the conveyance member conveys the developer, and in a direction opposite the developer conveyance direction;

an urging member configured to urge the developer conveyance plate in the direction opposite the developer conveyance direction; and a rotary member configured to contact a vibrated portion provided on the developer conveyance plate to press the developer conveyance plate in the developer conveyance direction against an urging force of the urging member, wherein the adjustment unit controls a rotating operation of the rotary member to adjust an amount of conveyance of the developer that is conveyed by the conveyance member.

3. The image forming apparatus according to claim 1, wherein the conveyance member includes:

a developer conveyance plate supported to be movable both in a developer conveyance direction, in which the conveyance member conveys the developer, and in a direction opposite the developer conveyance direction; and a vibration application member configured to vibrate the developer conveyance plate, wherein the adjustment unit controls a vibrating operation of the vibration application member to adjust an amount of conveyance of the developer that is conveyed by the conveyance member.

4. The image forming apparatus according to claim 3, wherein the adjustment unit adjusts a vibration frequency of the vibration application member.

5. The image forming apparatus according to claim 3, wherein the adjustment unit adjusts an acceleration difference between a forward path and a backward path of the conveyance member caused by the vibrating operation of the vibration application member.

6. The image forming apparatus according to claim 1, wherein the detection unit detects the developer amount near a developer bearing member, which bears the developer conveyed by the conveyance member.

7. The image forming apparatus according to claim 1, wherein the developer amount that is detected by the detection unit is a remaining amount of the developer.

8. The image forming apparatus according to claim 1, wherein the developer amount that is detected by the detection unit is a consumption amount of the developer.

9. The image forming apparatus according to claim 8, wherein the consumption amount of the developer is based on a printing ratio.

10. The image forming apparatus according to claim 9, wherein if a printing ratio of a subsequent recording material is higher than that of an immediately preceding recording material, the frequency of the vibration in the subsequent recording material is higher than that in the immediately preceding recording material.

11. The image forming apparatus according to claim 1, further comprising a second detection unit configured to detect a performance of conveyance of the developer, wherein the adjustment unit adjusts an amount of conveyance of the developer by the conveyance member using a result of detection by the second detection unit.

12. The image forming apparatus according to claim 11, wherein the second detection unit detects the performance of conveyance of the developer by detecting a rotation time of a developer bearing member, which bears the developer conveyed by the conveyance member, and wherein the adjustment unit adjusts the amount of conveyance of the developer by the conveyance member using the performance of conveyance of the developer detected by the second detection unit.

13. The image forming apparatus according to claim 1, further comprising:

a vibration application member configured to vibrate the conveyance member.

14. The image forming apparatus according to claim 1, wherein frequency of the vibration is in the range of 1.5 Hz to 45 Hz.

15. The image forming apparatus according to claim 1, wherein a first acceleration at which to move the conveyance member in a developer conveyance direction is lower than a second acceleration at which to move the conveyance member in a developer counter-conveyance direction.

16. The image forming apparatus according to claim 1, wherein the conveyance member has a flat surface on which the developer is provided.

17. The image forming apparatus according to claim 1, wherein the detection unit detects the consumption amount of the developer that a developer image formed on a recording material consumed and that is estimated by being based on a number of pixels of the developer image.

* * * * *